US011406151B2

(12) United States Patent
Tokko

(10) Patent No.: US 11,406,151 B2
(45) Date of Patent: Aug. 9, 2022

(54) HAIR EXTENSION ATTACHMENT

(71) Applicant: The Hair Shop, Inc., Los Angeles, CA (US)

(72) Inventor: Ryan Tokko, Los Angeles, CA (US)

(73) Assignee: THE HAIR SHOP, INC., Los Angeles, CA (US)

( * ) Notice: Subject to any disclaimer, the term of this patent is extended or adjusted under 35 U.S.C. 154(b) by 585 days.

(21) Appl. No.: 16/354,200

(22) Filed: Mar. 15, 2019

(65) Prior Publication Data

US 2020/0113262 A1 Apr. 16, 2020

Related U.S. Application Data

(60) Provisional application No. 62/744,629, filed on Oct. 11, 2018, provisional application No. 62/768,119, filed on Nov. 16, 2018, provisional application No. 62/772,080, filed on Nov. 27, 2018, provisional application No. 62/772,555, filed on Nov. 28, 2018.

(51) Int. Cl.
*A41G 5/00* (2006.01)

(52) U.S. Cl.
CPC ..... *A41G 5/0066* (2013.01); *A41G 5/0086* (2013.01)

(58) Field of Classification Search
CPC ..... A41G 5/0066; A41G 5/0086
See application file for complete search history.

(56) References Cited

U.S. PATENT DOCUMENTS 3,608,095 A * 9/1971 Barry ..... A61F 2/10 128/898
3,858,245 A * 1/1975 Nate, II ..... A61F 2/10 128/898
4,054,954 A * 10/1977 Nakayama ..... A61F 2/10 128/898
4,103,365 A * 8/1978 Applegate ..... A61F 2/10 128/898
5,074,874 A * 12/1991 Yoon ..... A61B 17/06004 606/224
5,868,145 A 2/1999 Spann
6,109,274 A 8/2000 Ingersoll
6,405,736 B2 6/2002 Townsend
7,032,602 B2 4/2006 Chang
7,201,171 B2 4/2007 Sthair
7,252,093 B2 8/2007 Rodriguez
7,343,921 B2 3/2008 Salinas
7,458,383 B2 12/2008 Song
(Continued)

*Primary Examiner* — Nicholas D Lucchesi
(74) *Attorney, Agent, or Firm* — Lewis Roca Rothgerber Christie LLP

(57) ABSTRACT

A method of attaching hair extension to customer's hair includes steps of forming beads with strands of customer s hair using bead forming devices and attaching hair extension to the beads using a hair extension attachment device. The hair extension attachment device includes a weft that holds extension hair strands, an attachment thread fixed to the base weft, an attachment needle fixed to a free end of the attachment thread. The bead forming devices includes a bead tube, a first bead thread that passes through the bead tube, a first bead handle that connects both ends of the first bead thread, a second bead thread that passes through the bead tube and a second bead handle that connects both ends of the second bead thread. The bead tube is positioned between the first bead handle and the second bead handle.

8 Claims, 18 Drawing Sheets

(56) References Cited

U.S. PATENT DOCUMENTS

| | | | | |
|---|---|---|---|---|
| 7,533,676 | B2 | 5/2009 | Sthair | |
| 7,661,434 | B2 | 2/2010 | Frazier | |
| 7,753,057 | B2 | 7/2010 | Kallabat et al. | |
| 7,992,576 | B2 | 8/2011 | Chang | |
| 8,025,065 | B2 | 9/2011 | Guliker | |
| 8,336,559 | B2 | 12/2012 | Kallabat et al. | |
| 8,739,803 | B2 | 6/2014 | Freelove | |
| 8,863,760 | B2 | 10/2014 | Verbonac | |
| 8,905,048 | B2 | 12/2014 | Peterson et al. | |
| 8,978,664 | B2 | 3/2015 | Springfield-Thomas | |
| 9,010,341 | B1 | 4/2015 | Lee | |
| 9,033,196 | B1 | 5/2015 | Smith | |
| 9,241,524 | B2 | 1/2016 | Burchard | |
| 9,339,072 | B2 | 5/2016 | Kenna | |
| 9,572,656 | B2 | 2/2017 | Jang | |
| 9,596,898 | B2 | 3/2017 | Seawright | |
| 9,968,150 | B2 | 5/2018 | Curbeon | |
| 10,058,138 | B2 | 8/2018 | Alex | |
| 2006/0060212 | A1* | 3/2006 | Rodriguez | A41G 5/0046 132/201 |
| 2008/0163882 | A1* | 7/2008 | Owens | A41G 5/006 132/201 |
| 2009/0014023 | A1* | 1/2009 | Waters | A41G 5/0066 132/201 |
| 2012/0067365 | A1* | 3/2012 | Brown | A41G 5/002 132/201 |
| 2012/0298127 | A1* | 11/2012 | Yi | A41G 5/0066 132/201 |
| 2014/0060566 | A1 | 3/2014 | Walker | |
| 2016/0235149 | A1* | 8/2016 | Seawright | A41G 5/006 |
| 2016/0262481 | A1* | 9/2016 | Kim | A41G 5/006 |
| 2017/0231308 | A1 | 8/2017 | Lee | |
| 2018/0116324 | A1* | 5/2018 | Harris | A41G 5/0073 |
| 2018/0228236 | A1* | 8/2018 | Curbeon | A41G 5/0073 |
| 2019/0125019 | A1* | 5/2019 | LeBeau | A41G 3/0016 |
| 2019/0357614 | A1* | 11/2019 | Rangel | A41G 5/006 |
| 2020/0260810 | A1* | 8/2020 | Tokko | A41G 5/0066 |
| 2020/0315275 | A1* | 10/2020 | Stuart-Richards | A41G 5/0086 |
| 2021/0059337 | A1* | 3/2021 | Turley | A41G 5/0053 |
| 2021/0274871 | A1* | 9/2021 | Davis | A41G 3/0075 |
| 2021/0292952 | A1* | 9/2021 | Brown | A41G 5/0086 |

* cited by examiner

HAIR EXTENSION ATTACHMENT

CROSS-REFERENCE TO RELATED APPLICATIONS

This application is based on the inventor's Provisional Application. No. 62/744,629 filed on Oct. 11, 2018, Provisional Application No. 62/768,119 filed on Nov. 16, 2018, Provisional Application No. 62/772,080 filed on Nov. 28, 2018 and Provisional Application No. 62/772,555 filed on Nov. 28, 2018, the disclosures of which are incorporated by reference.

BACKGROUND OF THE INVENTION

1. Field of the Invention

The present invention is related to a hair extension. More particularly, the present invention is related to a device and method for attaching a hair extension to a customer's natural hair.

2. Discussion of Related Technology

Generally, the hair extension technology connects one or more extension hair pieces to hair of a person or an animal. The extension hair pieces are to make the person/animal's hair look longer or thicker and/or add color accents to the person/animal's hair. The extension hair pieces for hair extension are in various forms and shapes, and include hair weaves, widgets, etc. In order to attach hair extension to customer's natural hair, various methods using metal tubes, double-sided tape, hair pins have been used. Extension hair pieces are expensive, and the handling, storing and organizing of the extension hair pieces require a lot of care.

U.S. Pat. No. 7,343,921 to Salinas discloses a hair extension apparatus that includes an anchor band with mounting holes for accepting a portion. Of customer's hair strands and tubular ferrules that hold customer's hair strands. Salinas has disadvantage that the tubular ferrules are semi-circular and only loosely hold hair strands; and passing customer's hair strands through the closely arranged numerous mounting holes required very lengthy labor. Crisscrossing client hair in Salinas uses a bead with an open side. Such open type bead is not useful due to lack of squeezing power. In addition, crisscrossing in Salinas just serves the purpose of tightening the weft.

US2017/0231308 to Lee discloses attaching a hair extension to scalp hair by interweaving the hair extension to scalp hair to form braided section. Lee has disadvantage that long and cumbersome manual works are required to form the braided sections.

U.S. Pat. No. 9,596,898 to Seawright discloses a method of providing a wetted hair extension having artificial hair, a sew-in needle and a thread pair extending therefrom. The method includes parting the person's natural hair so as to form a plurality of adjacent hair root sections forming a starter knot about a starter root section by looping the thread pair about the starter root section using the sew in needle.

U.S. Pat. No. 8,739,803 to Freelove discloses a hair cluster having a hair flap which comprises hair wefts. The hair wefts are sewn together with thread using a zigzag stitch.

U.S. Pat. No. 10,058,138 to Alex discloses a hair band with a lateral and longitudinal stretchable foundation carries a plurality of no-looped-hair hairband strips in a brick layered pattern.

U.S. Pat. No. 9,968,150 to Curbeon discloses a foundation of an elastic mesh into which wefts of natural hair are sewn.

U.S. Pat. No. 9,572,656 to Jang discloses a skits weft having a stitched portion, a resin tape welded to a surface of the stitched portion, and a bonding component attached to a surface of the resin tape.

U.S. Pat. No. 9,339,072 to Kenna discloses a hair extension packaged with double sided tape attached to both sides of the hair extension, with the weft and human or synthetic fiber hair attached between the two pieces of tape.

U.S. Pat. No. 9,241,524 to discloses a weft and a micro-cylinder, threading a segment of natural hair through the micro-cylinder, inserting the i-tip into the micro-cylinder and crimping the micro cylinder to secure the i-tip.

U.S. Pat. No. 9,010,341 to Lee discloses a weft clip free that fixedly attached to a base frame. The weft clips hold the weft of a hair extension between the weft clip and rectangular base.

U.S. Pat. No. 8,978,664 to Springfield-Thomas discloses a holder for hair extension that includes a length, a transverse profile having a hair extension edge and a securing edge opposingly disposed from the hair extension edge. The holder comprises a channel disposed substantially longitudinally along the entire length of the holder and a plurality of apertures to receive a plurality of attaching means for securing the holder to the wearer's natural hair.

U.S. Pat. No. 8,905,048 to Peterson et al. discloses a lace weft hair extension comprising a first layer of lace, extension hair knotted into the first layer to define a weft base, a knot sealant/bonding agent applied to the weft base, and a second layer of lace bonded to the first layer over the weft base.

U.S. Pat. No. 8,863,760 to Verbonac discloses a hair extension to adhesively secure a hair weft at areas of exposed skin behind a wearer's ears to avoid damage to the wearer's natural hair.

U.S. Pat. No. 8,336,559 to Kallabat et al. discloses micro rings that are fixed to the skin weft and provide an anchoring feature for strands of human hair from a scalp to be secured thereto.

U.S. Pat. No. 8,025,065 to Guliker discloses a hair piece having a thin elongated weaving band connection opening, through which hairs are passed.

U.S. Pat. No. 7,661,434 to Frazier discloses hair extensions that include a span of attachment hair strands extending from the weft base or edge of the attachment. The attachment hair strands are braided or intertwined directly into braids formed in the native hair of the wearer as those braids are being formed, without the need for additional attachment apparatus.

U.S. Pat. No. 7,533,676 to Sthair discloses a hair extension that includes a plurality of hair strands attached to a base support having a strip of double sided self adhesive tape with a removable backing and extended securing wings.

U.S. Pat. No. 7,458,383 to Song discloses a weft for hair extension that provides a plurality of space portions through which the real hair is passed between a pair of wig hair bundles that are bound to form the weft for hair extension and fixedly extends the real hair that is passed through the space portions to the weft for hair extension by use of a plurality of pressure rings.

U.S. Pat. No. 7,201,171 to Sthair discloses a hair extension that is comprised of a plurality of hair strands attached to a base support made of polyurethane which has a rectangular strip of double sided self-adhesive tape with a removable backing as a fastener.

U.S. Pat. No. 6,405,736 to Townsend discloses a self-adhesive hair extension that comprises air strands attached to a base support comprising a strip of woven material or hair attachment weave or welt at one end. A fastener comprising a self-adhesive tape portion and removable backing is sewn or otherwise secured by stitching to the hair extensions in order to prevent the adhesive tape from being separated or repositioned during use.

U.S. Pat. No. 5,868,145 to Spann discloses that a weft of natural or synthetic supplemental hair is suspended upon a mounting surface. A small bundle of supplement hair is segregated from the weft. A liquid latex is applied thereto.

US 2014/0060566 A1 to Walker discloses a hair weft that comprises intergap attachment regions positioned along a first weft band and a second weft band, adjoining the first weft band to the second weft band.

U.S. Pat. No. 7,753,057 to Kallabat et al. discloses a skin weft of flexible material having hair like fibers uniformly displaced thereon. Micro rings are fixed to the skin weft and provide an anchoring feature for strands of human hair from a scalp to be secured thereto. A disadvantage of Kallabat is that a user may feel the attached hair extension heavy.

U.S. Pat. No. 9,596,898 to Seawright discloses a method using a wefted hair extension having artificial hair, a sew-in needle and a thread pair extending therefrom.

U.S. Pat. No. 6,109,274 to Ingersoll discloses gathering strands of the wearer's natural hair into a first tuft; feeding the first tuft through a hole in a first linking attachment member; gathering several more strands of hair into a second tuft and feeding it through the hole in the opposite direction. Then the hair is secured in the linking member by crimping. Next, further strands of natural hair are added to the first tuft creating a third tuft, which are fed through a hole in a second linking attachment member creating a securing base of hair between and with the linking members.

U.S. Pat. No. 7,032,602 to Chang discloses that an upper inserting part of an flexible wire-form hair guiding loop, in which a hanging part is formed in the middle part and an inserting part and a drawing out part are formed in the upper part, is inserted from the lower part to the upper part of the hair connecting tube so that the inserting part is exposed toward the upper part of the hair connecting tube.

U.S. Pat. No. 7,992,576 to Chang discloses a fastening ring formed in a hollow shape, each respective upper end of the extended hairs being attached to an inner peripheral surface of the fastening ring; a guiding loop having a portion thereof received in the fastening ring and a guiding and holding part formed at the lower end thereof, the guiding loop being removable from the fastening ring; and a drawing loop having a portion thereof received between an inner wall of the fastening ring and the corresponding part of the guiding loop and a drawing and holding part formed at the lower end thereof, the drawing loop being removable from the fastening ring. U.S. Pat. No. 9,033,196 to Smith discloses a pre-threaded and knotted needle with a length of thread knotted though the eye of the needle and a connection securing the ends of the thread and a sleeve securing a bundle of the thread. U.S. Pat. No. 7,252,093 to Rodriguez discloses hair extension method including steps of determining a location around a scalp for attaching at least one extension hair; gathering a first croup of original hair, inserting a portion of the first group of original hair in a first band; inserting a portion of the first group of the artificial support material in the first band.

Attaching a hair extension to a customer's hair is a difficult and time-consuming task. If a heating device or a crimping device is used, preparing and handling the devices require care to avoid risk of hurting the hair and the scalp. Time required to secure the hair extension firmly and to provide natural appearance after securing depends on which method and device are used in attaching the hair extension. A hair extension attaching device and method that enables easy and fast attachment work have long been in need. The foregoing discussion in this section is to provide general background information and does not constitute an admission of prior art.

SUMMARY OF THE INVENTION

An objective of the invention is to provide easy and strong attachment device and method for attaching hair extension to a customer's hair.

In order to achieve the objective, the present invention provides a hair extension attachment device comprising a base weft that is adapted to hold a plurality of extension hair strands; an attachment thread having a predetermined length and fixed to the base weft; an attachment needle fixed to a free end of the attachment thread; and a plurality of extension hair strands fixed to the base weft.

The attachment needle has a predetermined curvature. A plurality of guide holes for guiding the attachment needle are provided on the base weft with a predetermined interval. The attachment thread is sewn to the base weft along its entire length.

The hair extension attachment device further comprises a second weft that is adapted to hold a plurality of extension hair strands, wherein the second weft is aligned with the base weft.

The hair extension attachment device further comprises one or more bead forming device, which comprises a bead tube; a first bead thread that passes through the bead tube; a first bead handle that connects both ends of the first bead thread; a second bead thread that passes through the bead tube; and a second bead handle that connects both ends of the second bead thread. The bead tube is positioned between the first bead handle and the second bead handle.

The bead tube is crimped after the first bead thread pulled by the first bead handle passes through the bead tube and the second bead thread pulled by the second bead handle passes through the bead tube whereby strands of customer's hair are guided through the bead tube from both ends of the bead tube, thereby forming a bead with the crimped bead holding the strands of the customer's hair firmly. The attachment thread sews the bead to the base we thereby fixing the base weft to the beads formed by the bead forming devices.

A method of attaching a hair extension to a customers hair according to the present invention comprises steps of forming one or more beads with strands of customer's hair using the bead forming devices; and attaching a hair extension to the beads using the hair extension attachment device.

In the bead forming step, the first bead thread pulled by the first bead handle passes through the bead tube and the second bead thread pulled by the second bead handle passes through the bead tube whereby strands of customer's hair are guided through the bead tube from both ends of the bead tube, and then the bead tube is crimped thereby forming a bead with the crimped bead tube holding the strands of the customer's hair firmly.

In the hair extension attaching step, the attachment needle is passed around the bead tube and penetrates the base welt thereby fixing the base weft to the beads. Alternatively, in the hair extension attaching step, the attachment needle is passed around the bead tube and guided through the guide holes thereby fixing the base weft to the beads.

Another embodiment of a hair extension attachment device comprises a weft that is adapted to hold a plurality of extension hair strands; and a plurality of bead forming devices. The weft comprises a plurality of fastening holes arranged with predetermined interval along the length of the weft. The bead forming devices may be fixed at predetermined positions along the weft.

The advantageous effects of the present invention are: (1) the hair extension attaching device and method provides rich and natural appearance of the extension hair; (2) the hair extension attachment devise is easy to use even by an unexperienced user; (3) no additional device is needed; (4) proper dimensions of components of the bead forming device prevent jamming of the thread inside the bead tube; (5) crisscrossing client's hair with using the double looped bead enables the crisscrossing work easy; (6) crisscrossed knot of client's hair is used as base anchor for sewing weft hair to client's hair; (7) the needle is preinstalled to the weft that saves time to assemble the needle to the thread; (8) using single thread prevents entanglement, which is common when double threads are used.

BRIEF DESCRIPTION OF THE DRAWINGS

The accompanying drawings illustrate the best embodiments of the present invention. In the drawings:

FIG. 4 is a perspective view showing that a bead forming device is placed near combed hair of a customer;

FIG. 5 is a perspective view showing that customer's hair strands are guided and drawn through a bead tube using a first bead thread of the bead forming device, wherein the hair strands are passed through the bead tube by pulling the first bead handle;

FIGS. 6 and 7 are perspective views showing that customer's hair strands are drawn through a loop formed by the second bead thread by pulling the second bead handle;

FIG. 8 is a perspective view showing that the bead tube is crimped to be flat;

FIG. 9 is a perspective view showing the crimped bead tube which forms a criss-crossed bead anchor;

FIG. 10 is a perspective view showing multiple bead or anchor points;

FIG. 11 is a perspective view showing that the hair extension attachment device is fixed to the criss-crossed bead anchors by sewing using the thread and the needle, wherein the needle is guided around the anchor point and is penetrated through the weft, wherein the thread is single to prevent interference between two threads, the needle is firmly and seamlessly fixed to the free end of the single thread with a glue, knotting, etc. in manufacturing plant;

FIG. 12 is a perspective view showing completion of sewing the hair extension attachment device to the beads, wherein the hair extension attachment device sewn near the two ends of the bead tube;

FIG. 15 is a perspective view shoving tightening of the hair attachment device by pulling customer hair bundles using both hands;

DESCRIPTION OF PREFERRED EMBODIMENTS

Embodiments will be described in detail below. The accompanying drawings will be used for describing embodiments. For the sake of convenience of illustrating embodiments, thickness, length, diameter, size and other dimensions of components and/or hair would be illustrated or exaggerated to be different with those of actual components and/or hair, and the subject matter of this application is not limited to the illustrated embodiments.

Figure 1:
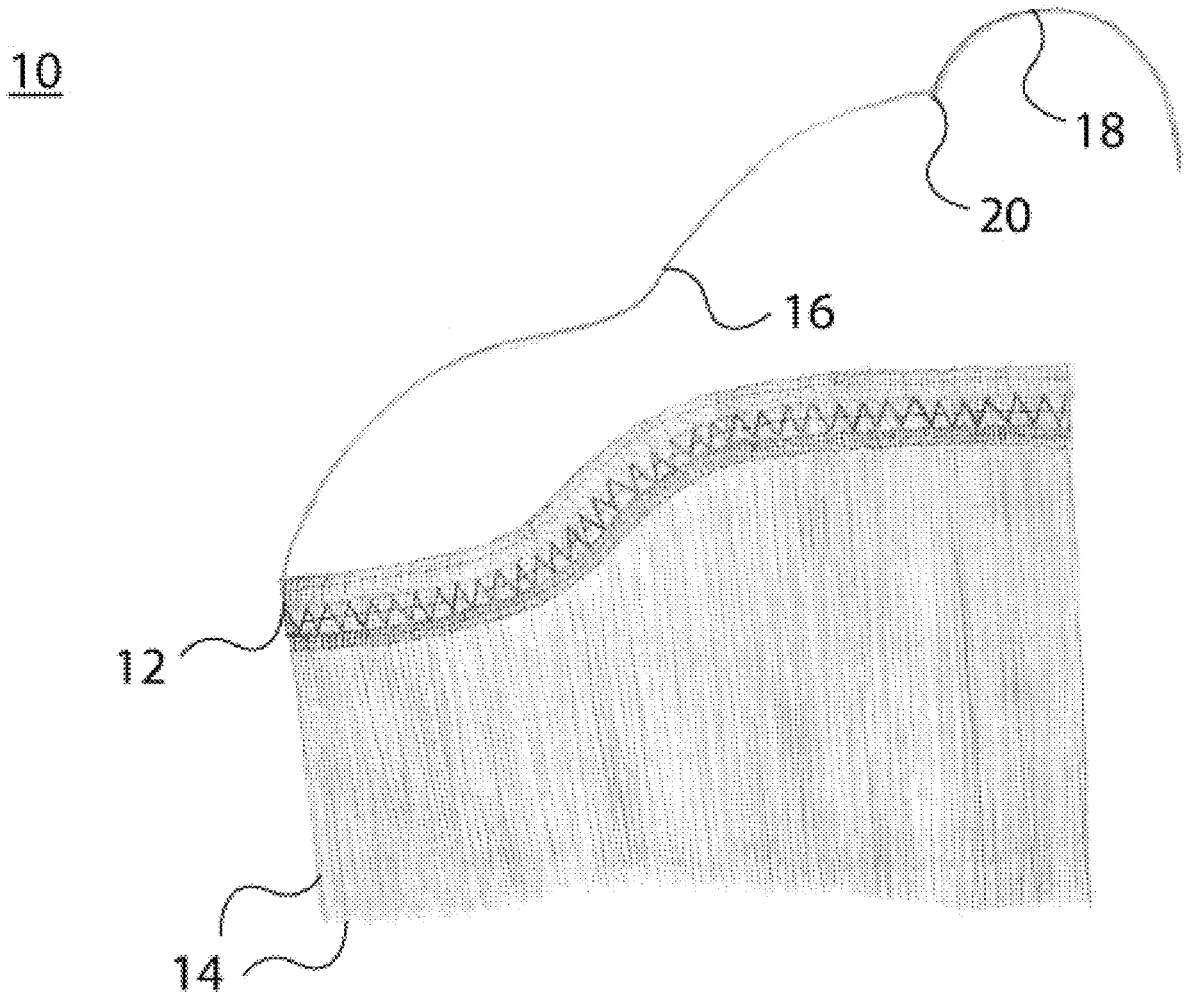
FIG. 1 is a perspective view showing a hair extension attachment device, wherein a sewing thread is fixed to one or two hair extension wefts, a curved needle is fixed to the end of the sewing thread, to save labor, the needle is provided prefixed to the sewing thread for this hair extension product, after sewing the weft(s) to customer's hair, remaining length of the sewing thread is cut and discarded with its prefixed needle.
Figure 2:
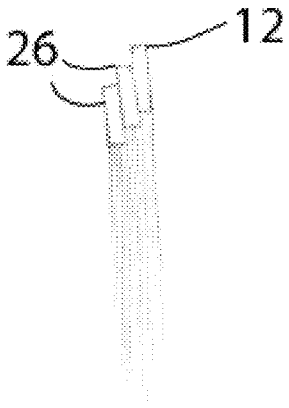
FIG. 2 is a side elevation view showing multiple wefts, wherein base weft, second weft, third weft are interwoven.
Figure 10:
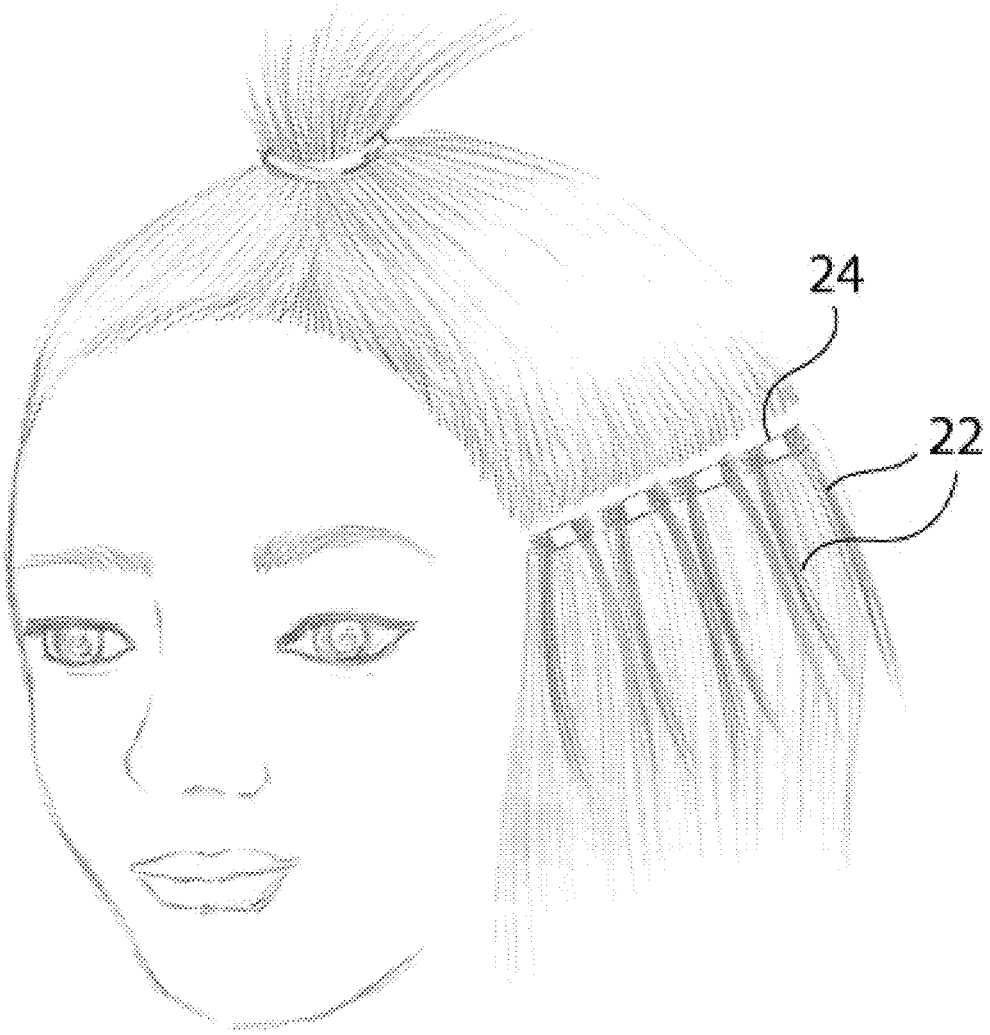
Figure 11:
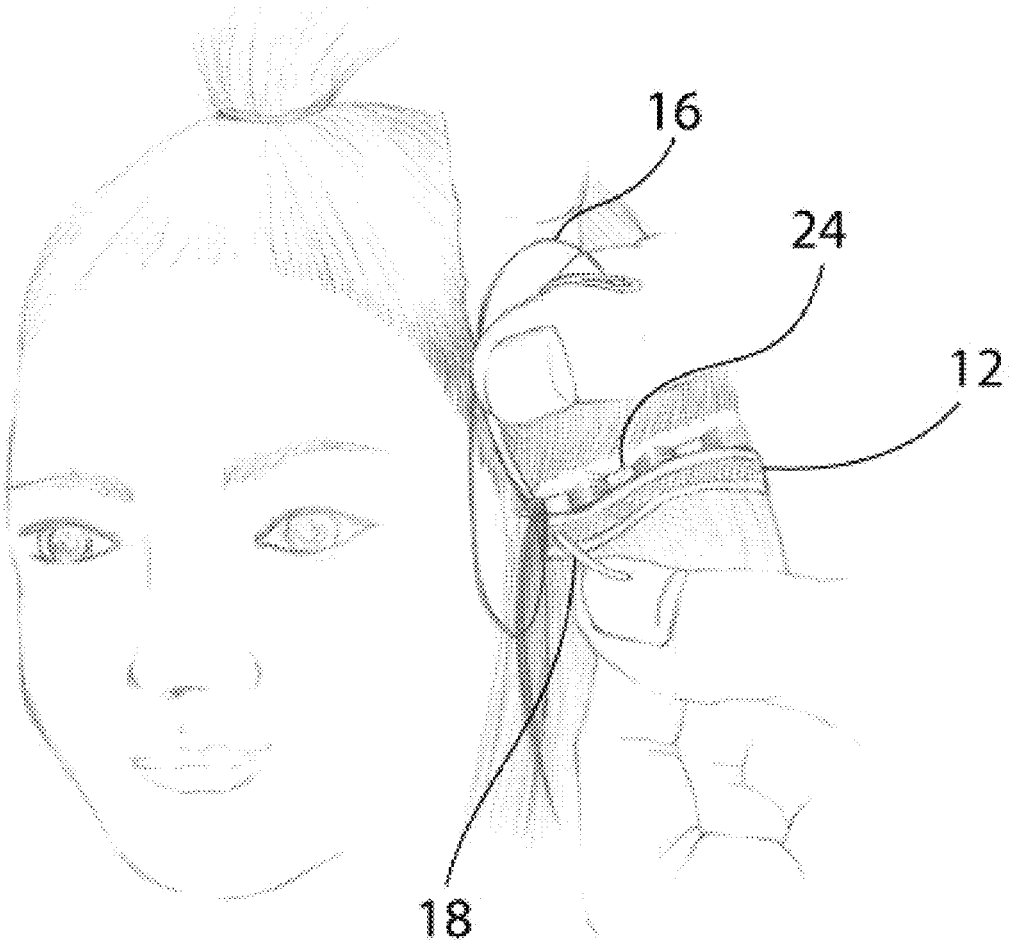

FIG. 1 shows a hair extension attachment device 10 comprising a base weft 12 that is adapted to hold a plurality of extension hair strands 14; an attachment thread 16 having a predetermined length and fixed to the base weft 12; and a curved attachment needle 18 fixed to an end 20 of the attachment thread 16. The predetermined length of the attachment thread is determined to facilitate sewing process with the attachment thread, and two or more times, preferably two to five times the length of the base weft in this embodiment. Preferably, the base weft is provided with lengths of 11", 9", 5.5", 3.5" and the corresponding lengths of the attachment thread 16 are 36", 29", 18", 12". Preferably, the attachment thread 16 is made of nylon. The attachment needle 18 is fixed to the free end of the attachment thread 16. When the attaching work is over, the unused length of the attachment thread 16 is cut and discarded together with the attachment needle 18. FIG. 10 shows that two bundles 22 of customer's hair strands pass through a tube in two directions resulting in x-shape beads or anchor points 24. Such arrangement is repeated as needed to provide attaching anchor points to attach a hair extension to a customer's hair. FIG. 2 shows that the hair extension attachment device 10 includes additional hair extension wefts 26. The additional hair extension wefts 26 are adapted to hold a plurality of extension hair strands. The additional hair extension wefts 26 are aligned with the base weft 12. The wefts may be sewn along their entire length to fix the wefts each other. In this way, multiple wefts are attached in one operation to provide rich extension hair appearance. To save labor, the attachment needle 18 is provided prefixed to the attachment thread 16 for this hair extension product. After sewing the weft(s) to customer's hair, remaining length of the attachment thread is cut and discarded with its prefixed attachment needle. The wefts may be made of cloth or polymer which facilitates sewing by the attachment thread.

The attachment needle 18 has a predetermined curvature. Since the attachment needle 18 is frequently manipulated near the scalp of a customer, the curvature helps to keep away the sharp end of the attachment needle as far as possible from the scalp of a customer. The attachment thread 16 is sewn to the base weft 12.

Figure 3A:
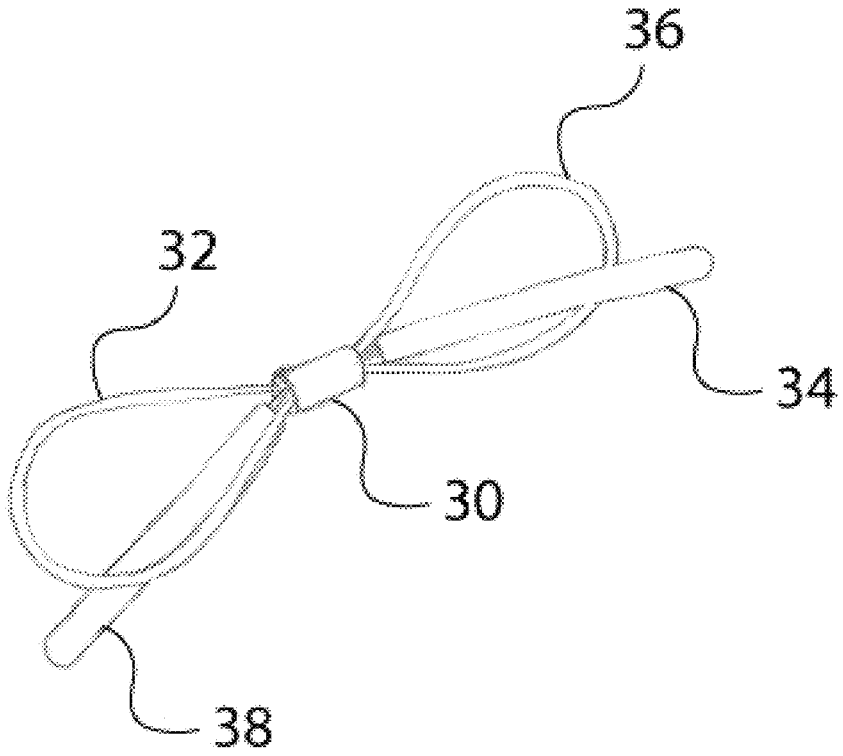
FIGS. 3*a* and 3*b* are a perspective view showing a hair bead forming device, wherein two nylon threads pass through a copper tube, each of the thread is connected by a plastic handle at its two ends, one of the thread handle assembly is assembled to the tube in opposite direction to the other thread handle assembly, wherein to prevent entangling of the first and second threads, the length of the handle is designed to be longer than the loop length of the thread.
Figure 3B:
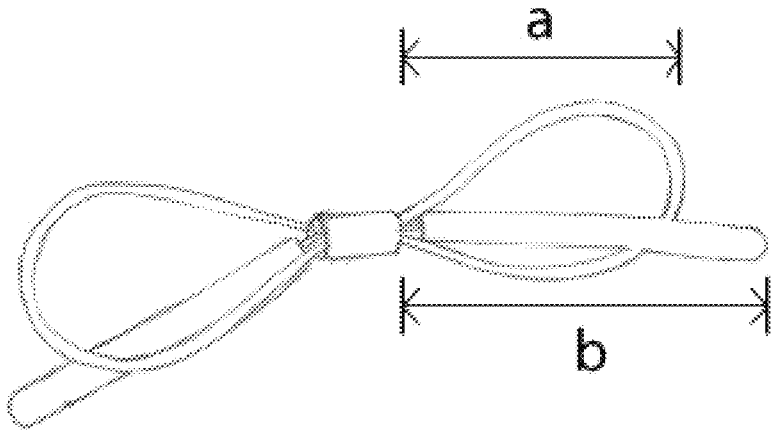
Figure 3C:
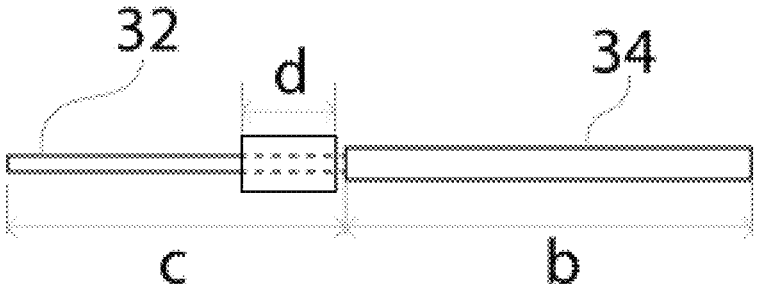
FIG. 3*c* is an elevation view showing the hair bead forming device.
Figure 4:
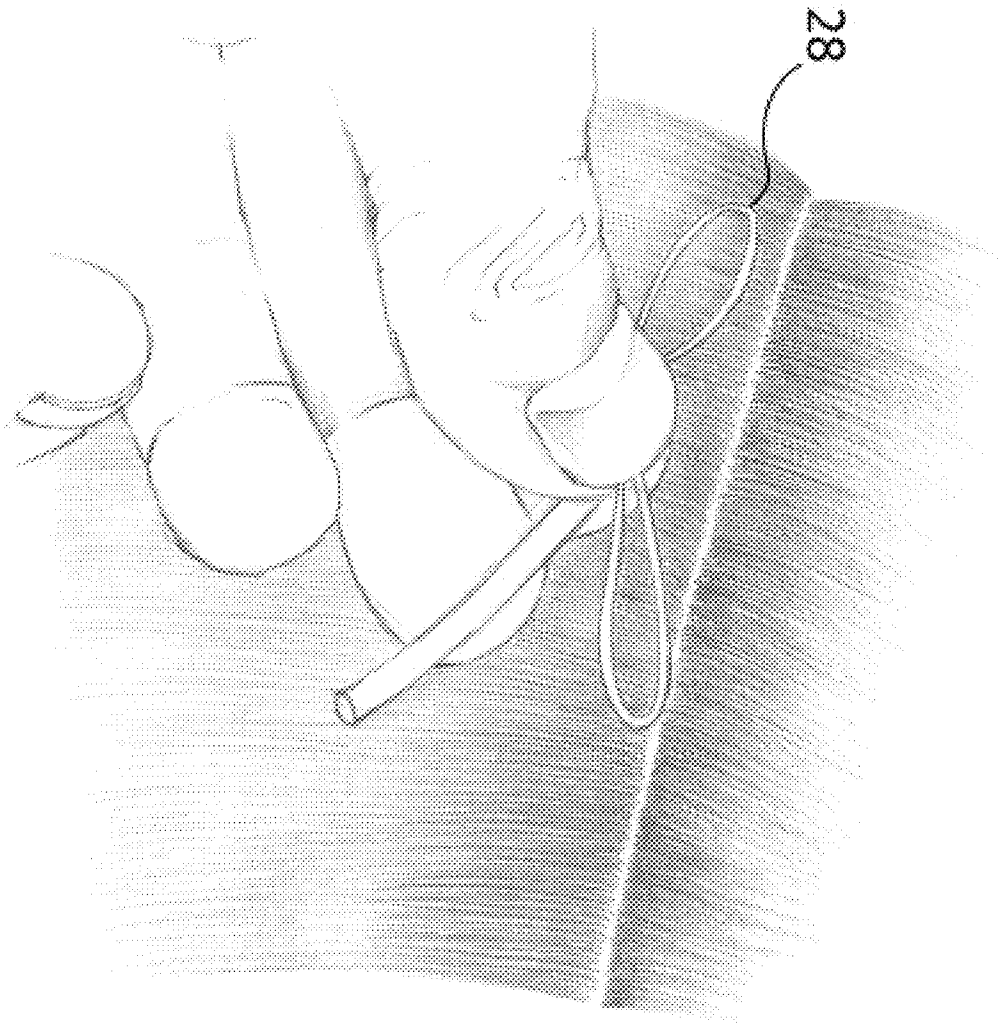
FIGS. 4-12 are schematic views showing a method of using the hair extension attachment device, wherein two bundles of customer's hair strands pass through a tube in two directions resulting in x-shape, such arrangement is repeated as needed to provide attaching points to attach a hair extension to a customer's hair.
Figure 5:
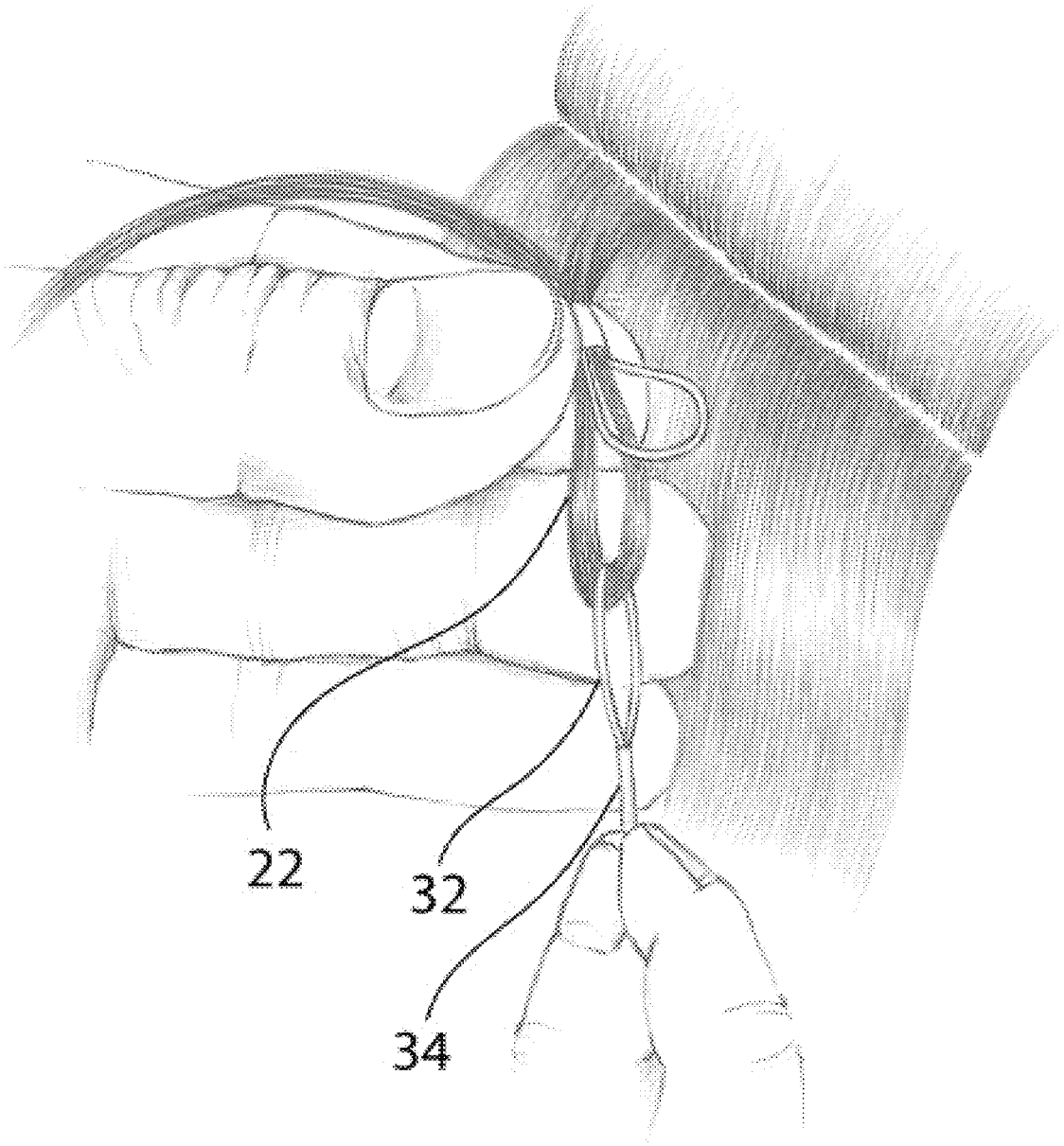
Figure 6:
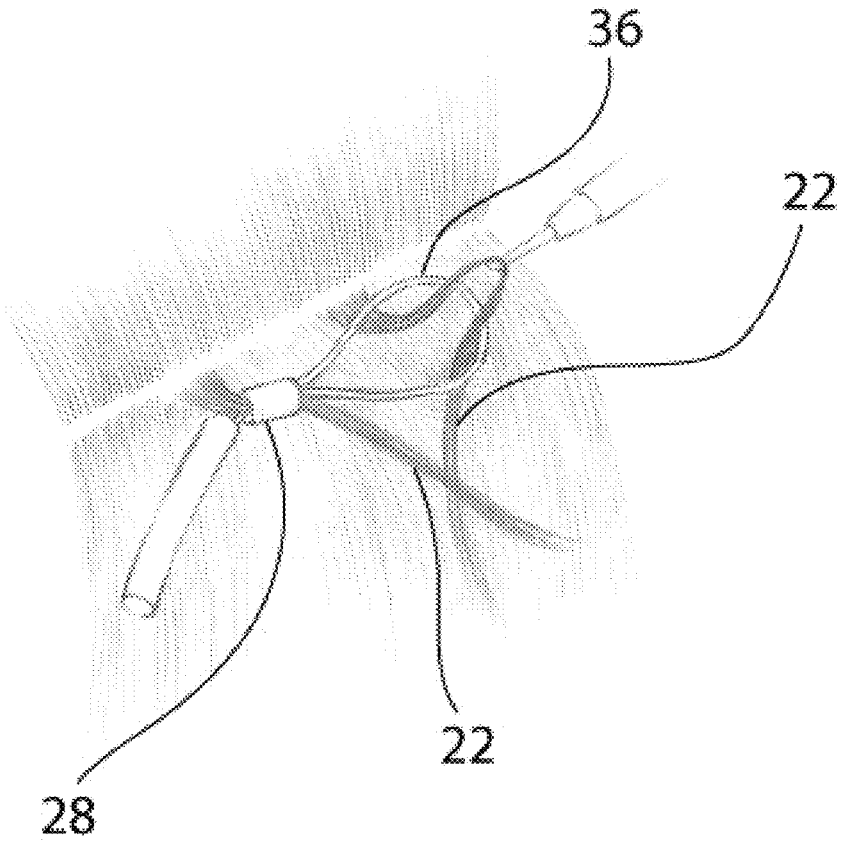
Figure 7:
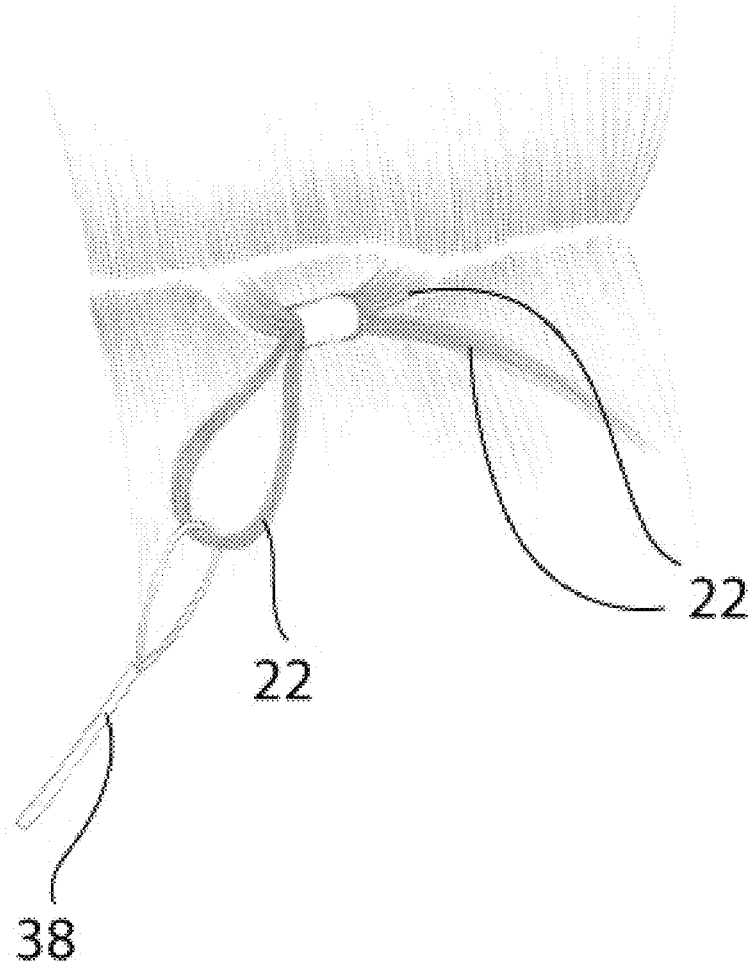
Figure 8:
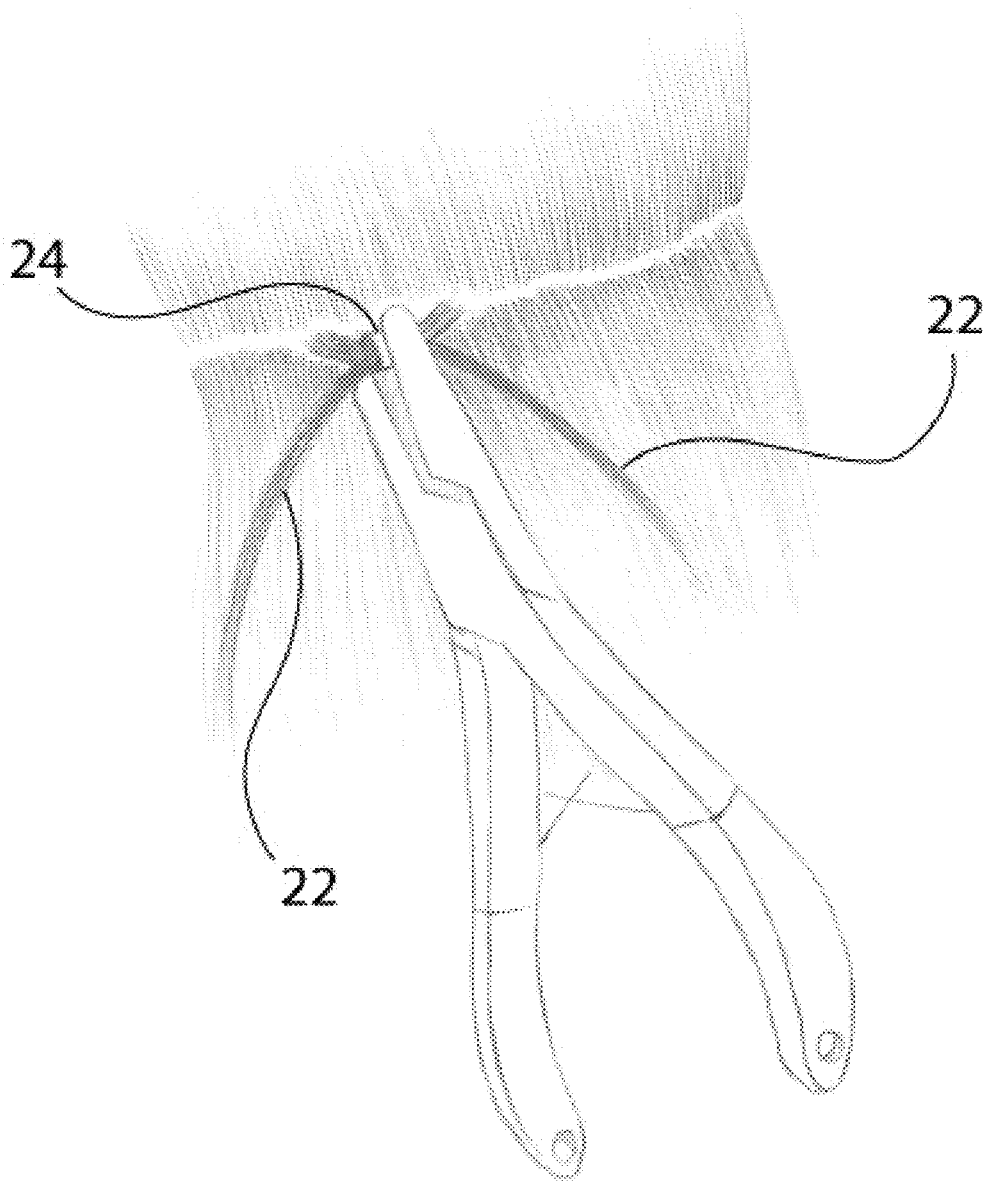
Figure 9:
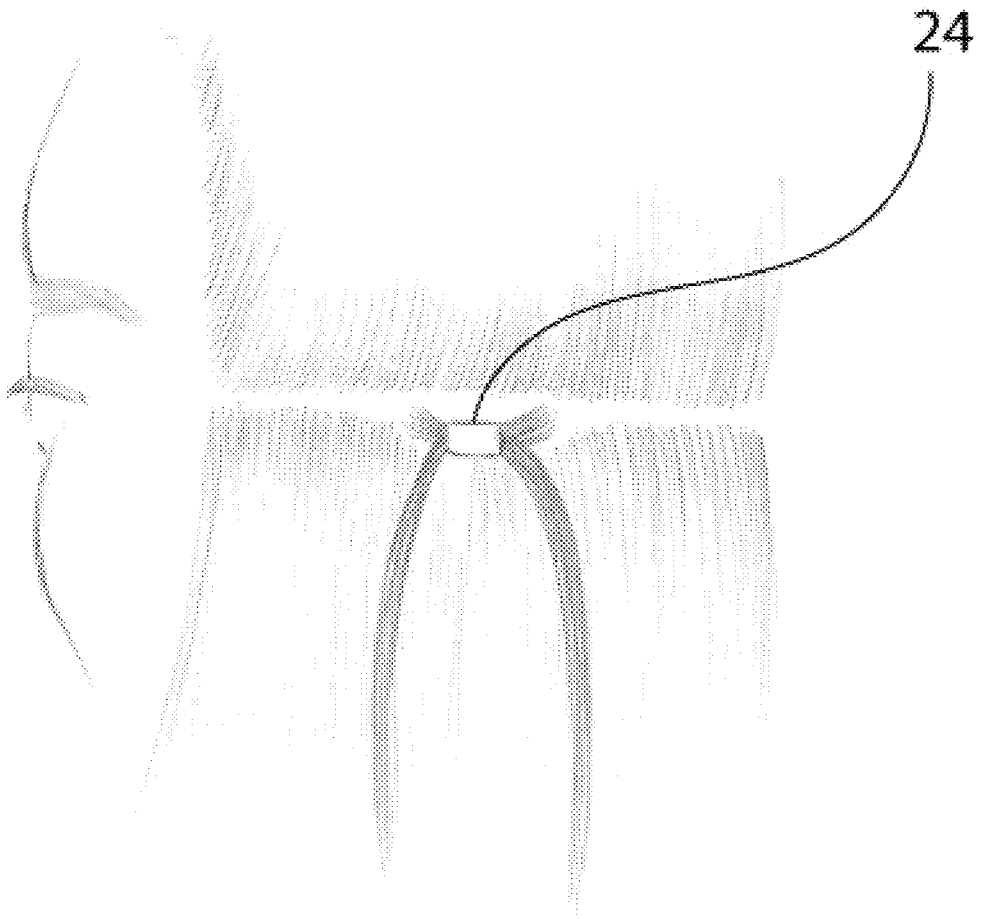

Referring to FIGS. 3*a* and 3*b*, the hair extension attachment device 10 further comprises one or More bead forming device 28, which comprises a bead tube 30; a first bead thread 32 that passes through the bead tube 30; a first bead handle 34 that connects both ends of the first bead thread 32; a second bead thread 36 that passes through the bead tube 30; and a second bead handle 38 that connects both ends of the second bead thread 36. The bead tube 30 is positioned between the first bead handle 34 and the second bead handle 38. Two nylon threads pass through a copper tube. Each of the thread is connected by a plastic handle at its two ends. One of the thread handle assembly is assembled to the tube in opposite direction to the other thread handle assembly. The bead tube 30 comprises a silicone lined metal tube. The bead handles 34, 38 are longer than the loops formed by the bead threads 32, 36 so that entangling of the bead threads would not occur. In FIG. 3*b*, the dimension of the loop, a is in range of 0.5 through 5 cm, and the dimension of the bead handle b is in a range of 1 through 6 cm. More specifically, referring to FIG. 3*c*, the length b of the bead handle 34 is bigger than half c of the length of the bead thread minus the length of the bead tube d. For convenience of illustration FIG. 3*c* shows only the first bead thread 32 and the first bead handle 34.

The bead tube 30 is squeezed after the first bead thread 32 pulled by the first bead handle 34 passes through the bead tube 30 and the second bead thread 36 pulled by the second bead handle 38 passes through the bead tube 30 whereby bundles 22 of customer's hair strands are guided through the bead tube 30 from both ends of the bead tube 30, thereby forming a bead or anchor point 24 with the squeezed bead tube 30 holding the strands of the customer's hair bundles 22 firmly. The attachment thread 16 sews the beads 24 to the base weft 12 (and the additional welt 26) thereby fixing the wefts 12, 26 to the beads 24 formed by the bead forming devices 28.

FIGS. 4-12 show the process how the hair extension is attached to a customer's hair. A method of attaching a hair extension to a customer's hair according to the present invention comprises step S1 of forming one or more beads with strands of customer's hair using the bead forming devices 28; and step S2 of attaching a hair extension to the beads using the hair extension attachment device 10.

In the bead forming step S1, the first bead thread 32 pulled by the first bead handle 32 passes through the bead tube 30 and the second bead thread 36 pulled by the second bead handle 38 passes through the bead tube 30 whereby strands of customer's hair are guided through the bead tube 30 from both ends of the bead tube 30, and then the bead tube 30 is crimped thereby forming a bead 24 with the crimped bead tube holding the strands of the customer's hair firmly.

Figure 12:
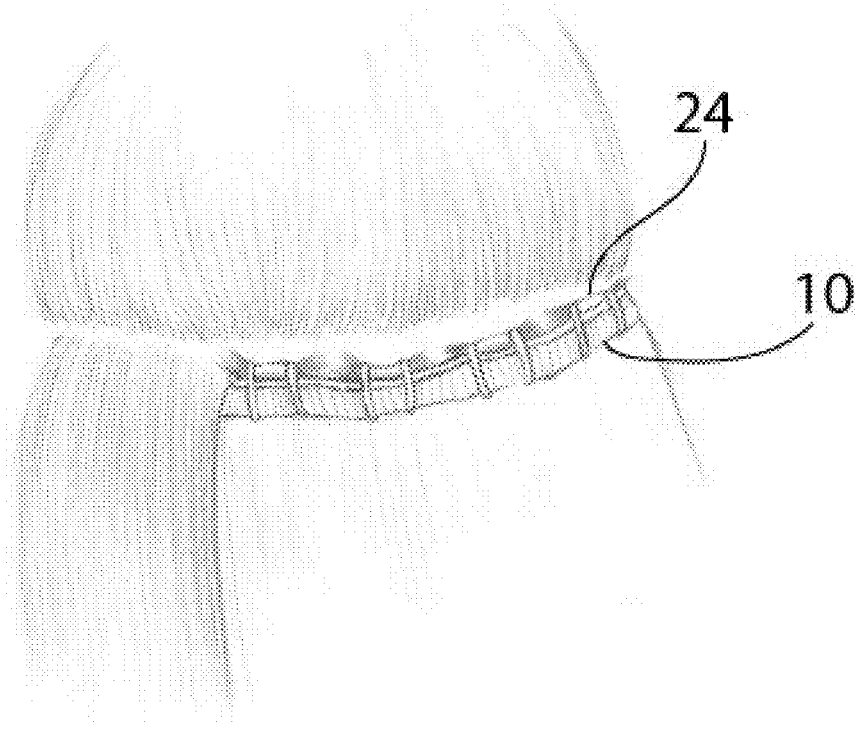

In the hair extension attaching step S2, the attachment needle 18 is passed around the bead tube 30 and penetrates the base weft 12 thereby fixing the base weft 12 to the beads 24. FIG. 12 illustrates the finished state, wherein the hair extension is firmly and stably attached to customer's natural hair and very close to the scalp providing better feeling and appearance, wherein compared to wefts by prior art in which customer's hair strands are parallel in the same direction as the extension hair strands, in the present invention customer's hair strands are perpendicular with the extension hair strands, no loosening occurs, in everyday life, and maintaining the extension hair, and shampooing, the present invention provides solid, natural, convenient feeling, 10-20 bead forming devices are provided with the weft(s) connected to the thread and the needle in a retail package.

Referring to FIG. 1*a*, the weft 12 comprises a plurality of guide holes 42 arranged with predetermined interval. Preferably, the weft is polyurethane base to facilitate punching the fastening holes 42. The bead forming devices 28, therefore the bead tubes 30 are fixed to the base weft 12 by sewing or gluing for example. The bead forming devices 28 are fixed at predetermined positions so that the loops formed by the bead threads are aligned with the guide holes 42. Customer's hair strands 22 are guided thorough the guide holes 42 and then the loops formed by the threads 32, 36. The bead tube 30 is squeezed after the first bead thread 32 pulled by the first bead handle 34 passes through the bead tube 30 and the second bead thread 36 pulled by the second bead handle 38 passes through the bead tube 30 whereby strands of customer's hair 22 are guided through the bead tube 30 from both ends of the bead tube 30 in crisscross pattern, thereby forming a bead with the squeezed bead tube holding the crisscrossed strands of the customer's hair firmly.

The single thread 16 may be fixed to the weft 12 either by making two knots or by using glue. To facilitate making the anchor base straighter, a plier with thin lower jaw should be used when making the crisscrossing bead.

Figure 13:
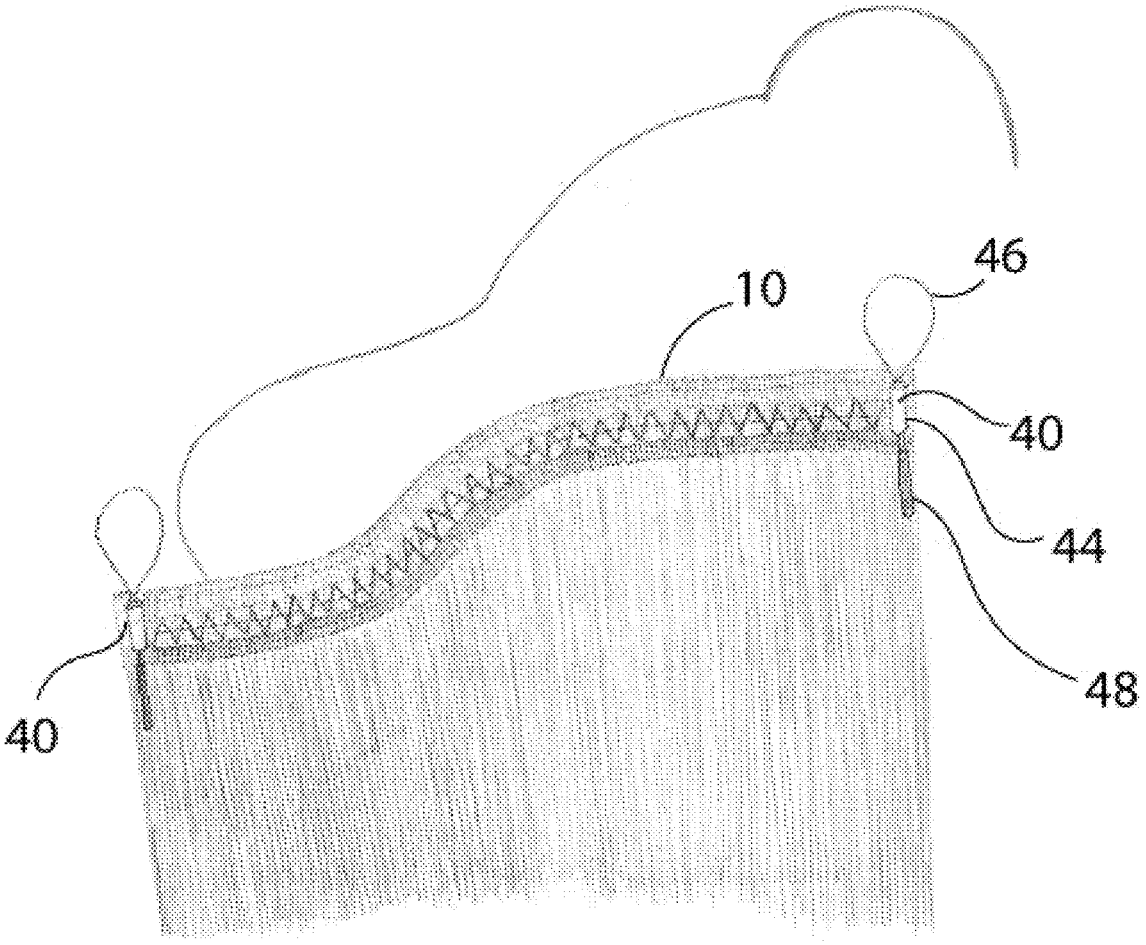

Referring to FIG. 13, the hair extension attachment device 10 further comprises two hair fixing devices 40 at both ends of the base weft 12. Each of the hair fixing devices 40 includes a bead tube 44, a bead thread 44 that passes through the bead tube and, a bead handle 48 that connects both ends of the bead thread. The hair fixing device fixed strands of customer's hair. In addition to sewing the weft to the anchor points, this fixing provides further attaching of the hair extension at both ends of the weft, thereby enhancing attachment of the hair extension.

Figure 14:
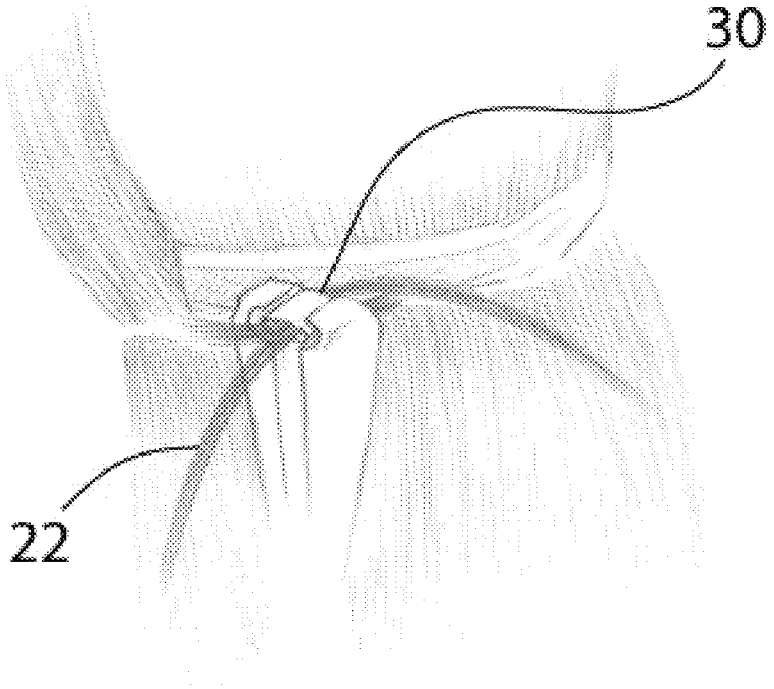
FIG. 14 is a perspective view showing that the bead tube uncrimped in order to retighten the hair extension weft that has been loosened due to grown customer's hair for example 8 weeks.
Figure 15:
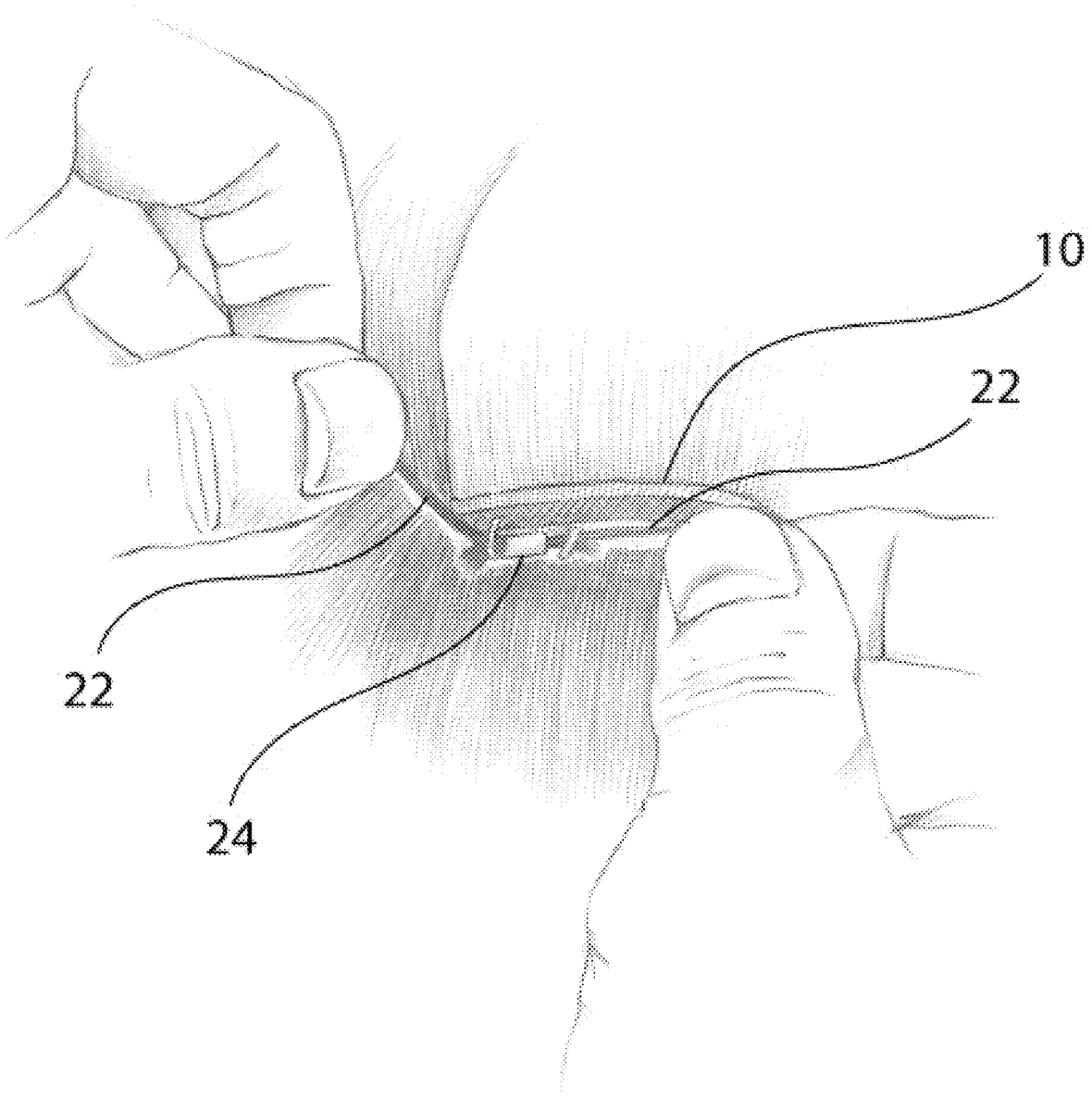
FIG. 15 is a perspective view shoving two hair fixing devices are attached at both ends of the weft.
Figure 16:
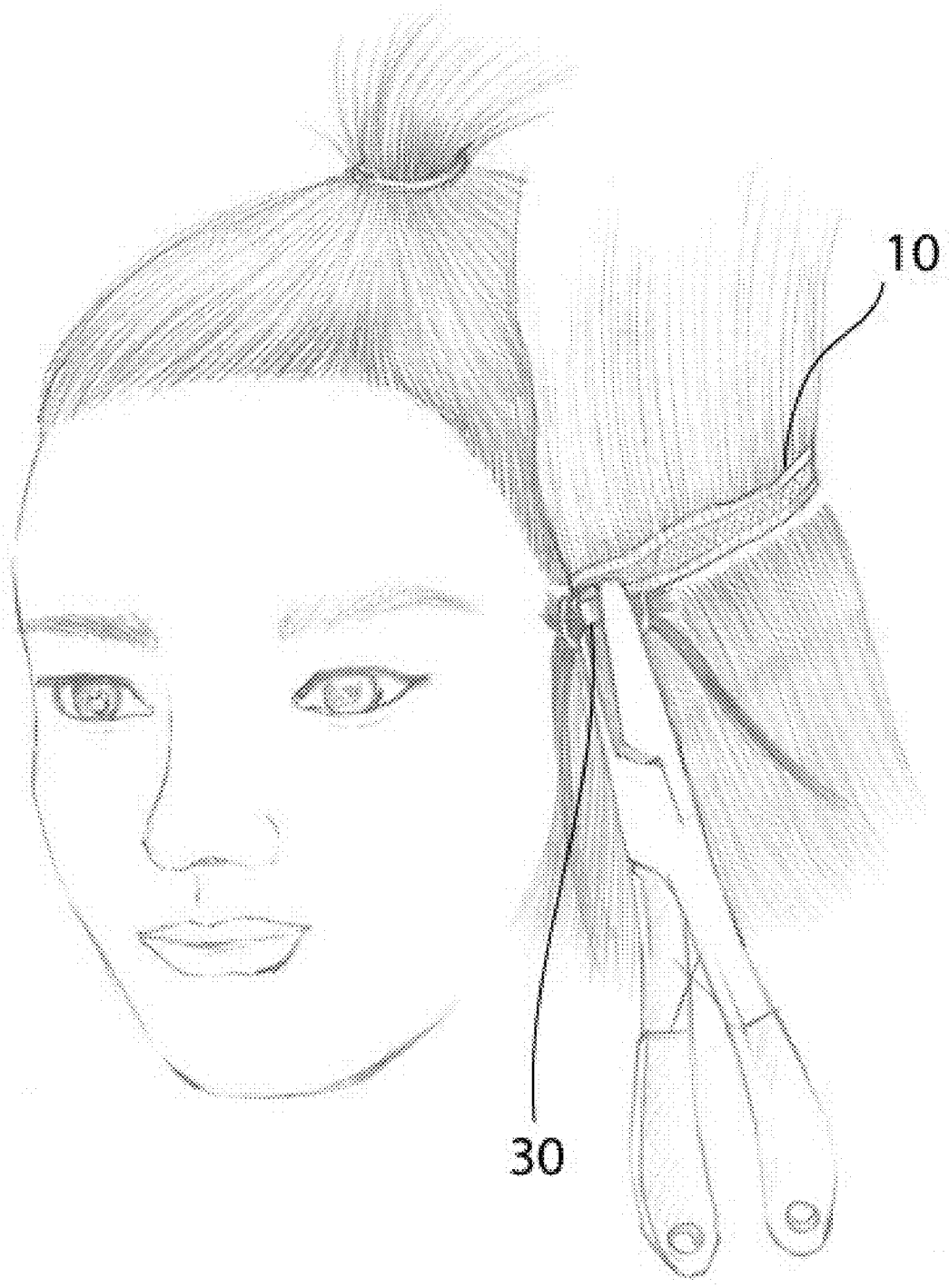
FIG. 16 is a perspective view showing that the bead tube crimped again.

FIGS. 14-16 illustrate unsqueezing or uncrimping the bead tube 30. When the customer's hair grows, the bead tubes 30 are unsqueezed, the entire wefts 12, 26 are pulled upward, and then the tubes are squeezed again to provide the tight state as when the hair extension is first attached, it is possible until the tube is broken.

Figure 17:
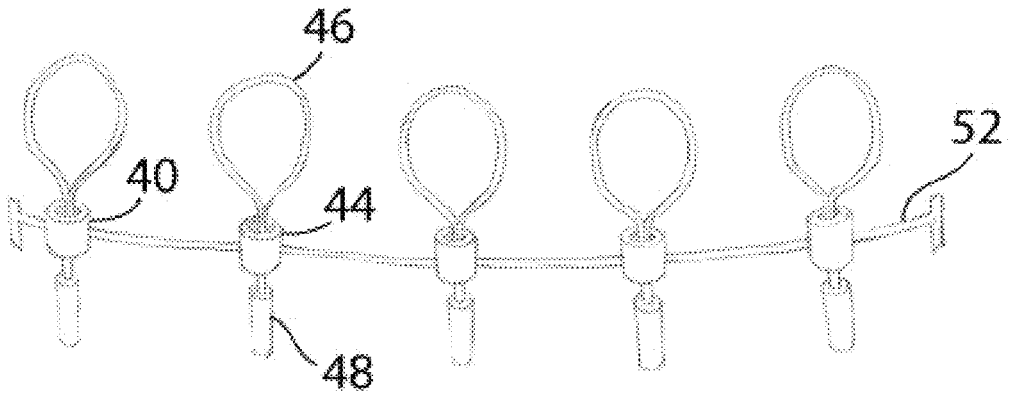
FIG. 17 is a front perspective view showing another hair attachment device including a plurality of hair fixing devices and a wire holding the hair fixing devices.
Figure 18:
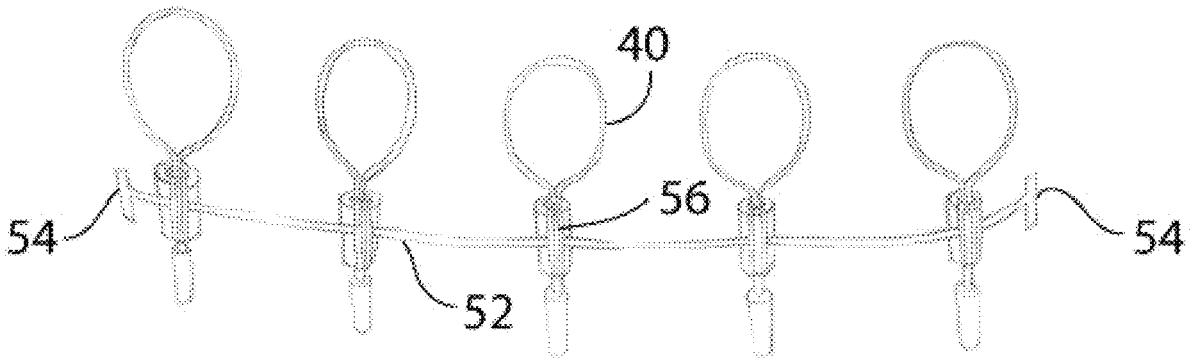
FIG. 18 is a rear perspective view of the hair attachment device.
Figure 19:
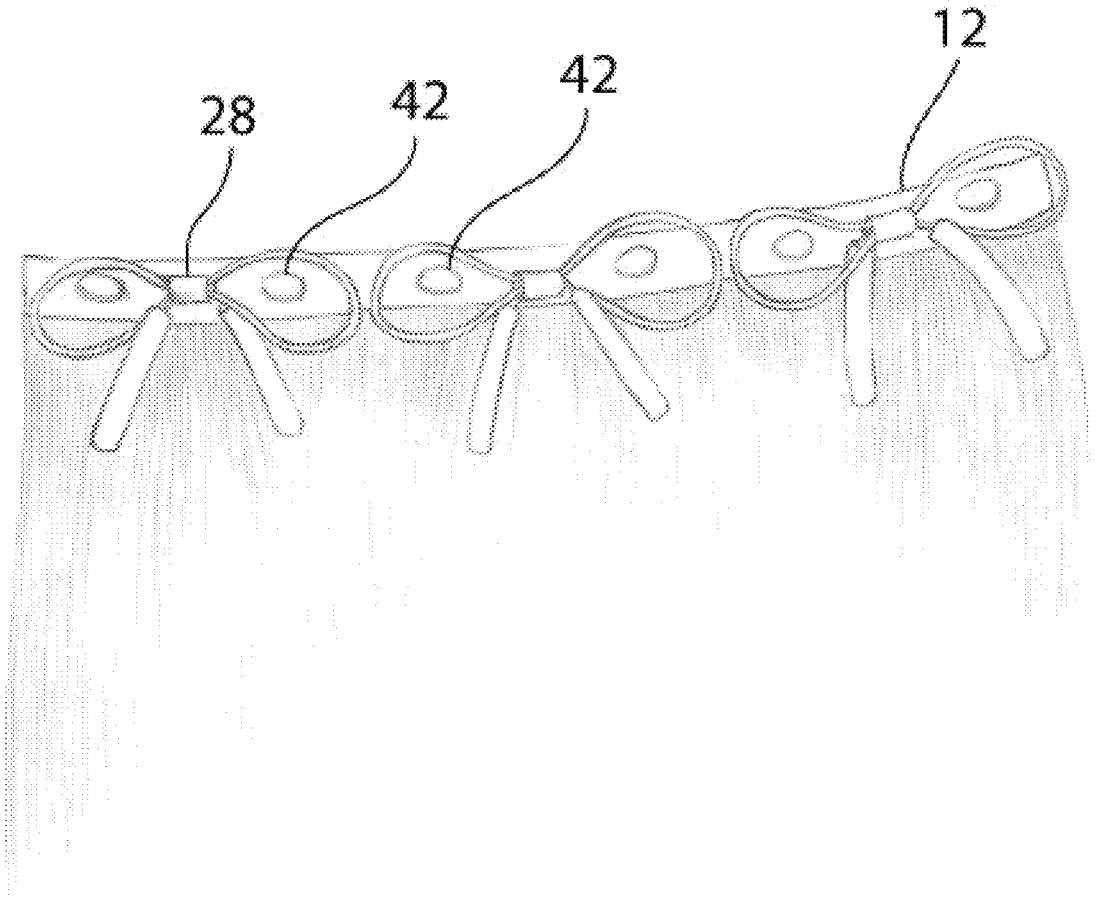
FIG. 19 is a perspective view showing still another hair extension attachment device that includes a plurality of bead forming devices pre-fixed to a weft.

Referring to FIGS. 17 and 18, a hair attachment device 50 includes a plurality of hair fixing devices 40, wherein each of the hair fixing devices 40 comprises a bead tube 44, a bead thread 46 that passes through the bead tube 44 and a bead handle 48 that connects both ends of the bead thread 44; and a wire 52, along which the hair fixing devices 40 are slidably attached. The wire 52 comprises two stoppers 54 at its ends, wherein each of the hair fixing devices 40 further comprises a string 56 that is wound around the external wall and the internal wall of the bead tube 44, wherein the wire 52 passes between the string 56 and the external wall of the bead tube. The wire is made of synthetic material or metal. Because the hair fixing devices 40 can freely slide along the wire 52, a user can adjust the interval between the hair fixing devices 40 appropriately depending on a customer's hair and a hair extension. The hair attachment device 50 can be easily assembled to any kind of hair extension weft by sewing etc. A bundle of customer's hair is fixed by the hair fixing device 40 thereby forming an anchor point for attaching hair extension weft.

Although the hair extension attachment device and method according to exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

The invention claimed is:

1. A hair extension attachment device comprising:
- a base weft that is adapted to hold one or more extension hair strands;
- an attachment thread coupled to the base weft;
- an attachment needle for sewing the attachment thread to the base weft; and
- a hair fixing device, coupled to the base weft, comprising:
  - a bead tube;
  - a bead thread configured to pass through the bead tube; and
  - a bead handle coupled to both ends of the bead thread.

2. The hair extension attachment device of claim 1, further comprising one or more additional wefts that are adapted to hold a plurality of extension hair strands, wherein the one or more additional wefts are aligned with the base weft.

3. The hair extension attachment device of claim 2, wherein the attachment needle has a predetermined curvature, and wherein the attachment needle is fixed to a free end of the attachment thread.

4. The hair extension attachment device of claim 3, further comprising a plurality of extension hair strands fixed to the base weft.

5. The hair extension attachment device of claim 2, wherein the attachment thread comprises a single thread.

6. A hair extension attachment device comprising:
- a base weft that is adapted to hold a plurality of extension hair strands;
- an attachment thread having a predetermined length and fixed to the base weft;
- an attachment needle connected to the attachment thread;
- one or more additional wefts that are adapted to hold a plurality of extension hair strands, wherein the one or more additional wefts are aligned with the base weft; and
- two hair fixing devices fixed at both ends of the base weft, wherein each of the hair fixing devices comprises a bead tube, a bead thread that passes through the bead tube and a bead handle that connects both ends of the bead thread.

7. A hair extension attachment device comprising:
- a base weft that is adapted to hold a plurality of extension hair strands;
- an attachment thread having a predetermined length and fixed to the base weft;
- an attachment needle connected to the attachment thread;
- one or more additional wefts that are adapted to hold a plurality of extension hair strands, wherein the one or more additional wefts are aligned with the base weft; and
- a first hair fixing device attached at one end of the base weft, and a second hair fixing device attached at the other end of the base weft, wherein each of the hair fixing devices comprises a bead tube, a bead thread that passes through the bead tube and a bead handle that connects both ends of the bead thread.

8. A hair extension attachment device comprising:
- a base weft that is adapted to hold a plurality of extension hair strands;
- an attachment thread having a predetermined length and fixed to the base weft;
- an attachment needle connected to the attachment thread;
- one or more additional wefts that are adapted to hold a plurality of extension hair strands, wherein the one or more additional wefts are aligned with the base weft; and
- one or more bead forming device, which comprises:
  - a bead tube;
  - a first bead thread that passes through the bead tube;
  - a first bead handle that connects both ends of the first bead thread;
  - a second bead thread that passes through the bead tube; and
  - a second bead handle that connects both ends of the second bead thread.

* * * * *